US010081890B2

(12) United States Patent
Tabibian

(10) Patent No.: US 10,081,890 B2
(45) Date of Patent: Sep. 25, 2018

(54) BENDABLE STRAIGHT KNITTING NEEDLE WITH TUBULAR MEMBER

(71) Applicant: Cyrus Tabibian, West Hills, CA (US)

(72) Inventor: Cyrus Tabibian, West Hills, CA (US)

(73) Assignee: Cyrus Tabibian, West Hills, CA (US)

( * ) Notice: Subject to any disclaimer, the term of this patent is extended or adjusted under 35 U.S.C. 154(b) by 0 days.

(21) Appl. No.: 15/485,537

(22) Filed: Apr. 12, 2017

(65) Prior Publication Data

US 2017/0298545 A1 Oct. 19, 2017

Related U.S. Application Data

(63) Continuation-in-part of application No. 14/599,284, filed on Jan. 16, 2015, now Pat. No. 9,637,848.

(51) Int. Cl.
*D04B 3/02* (2006.01)

(52) U.S. Cl.
CPC ..... *D04B 3/02* (2013.01)

(58) Field of Classification Search
CPC ..... D04B 3/02
USPC ..... 66/117–123
See application file for complete search history.

(56) References Cited

U.S. PATENT DOCUMENTS 1,999,691 A * 4/1935 Ghaham ..... D04B 3/02 66/117
2,061,282 A * 11/1936 LeBoff et al. ..... D04B 17/04 66/117
2,102,600 A * 12/1937 Miller ..... D04B 3/02 66/117
2,128,871 A * 8/1938 Wong ..... D04B 17/04 267/73
2,309,528 A * 1/1943 Otting et al. ..... D04B 3/02 66/117
2,414,353 A * 1/1947 Birmingham ..... D04B 17/04 66/117
2,456,718 A * 12/1948 Marinsky ..... D04B 17/04 165/909
2,462,473 A * 2/1949 Delaney ..... D04B 3/02 66/117
2,491,776 A * 12/1949 Skelton ..... E06B 9/266 223/102
2,532,409 A * 12/1950 Joho ..... D04B 17/04 66/117
2,544,429 A * 3/1951 Kadisch ..... D04B 17/04 66/117
2,586,733 A * 2/1952 Sologaistoa ..... D04B 17/04 66/117
2,633,720 A * 4/1953 Robbins ..... D04B 3/02 66/117

(Continued)

FOREIGN PATENT DOCUMENTS

DE 4012123 A1 * 9/1990 ..... D04B 3/02
DE 4110020 A1 * 10/1992 ..... D04B 3/02
GB 407145 A * 3/1934 ..... D04B 3/02

*Primary Examiner* — Danny Worrell

(57) ABSTRACT

A bendable straight knitting needle consisting of at least three parts that provides ergonomic benefit by enabling bending of the needle during stitch/loop creation by the knitter typically done with two knitting needles, one in each hand. This addition of the bendable portion to the standard conventional straight knitting needle would allow flexible knitting motion with enhanced comfort and better ease of knitting in a tight place.

7 Claims, 12 Drawing Sheets

Fig. 3

(56) References Cited

U.S. PATENT DOCUMENTS

| | | | | | |
|---|---|---|---|---|---|
| 2,718,131 | A * | 9/1955 | Black et al. | D04B 17/04 | 66/117 |
| 3,212,301 | A * | 10/1965 | Sumegi | D04B 17/04 | 66/117 |
| 3,280,595 | A * | 10/1966 | Linstead | D04B 3/00 | 66/117 |
| 4,501,133 | A * | 2/1985 | Kretzschmar | D04B 3/02 | 66/117 |
| 4,553,410 | A * | 11/1985 | Okada | D04B 3/02 | 66/117 |
| 4,680,947 | A * | 7/1987 | Phipps, Sr. | D04B 3/02 | 66/117 |
| 4,693,094 | A * | 9/1987 | Kahn | D04B 3/02 | 66/117 |
| 7,954,342 | B2 * | 6/2011 | Devagnanam | D04B 3/02 | 66/117 |
| 8,181,489 | B2 * | 5/2012 | Selter | D04B 3/02 | 66/117 |
| 8,464,559 | B2 * | 6/2013 | West | D04B 3/02 | 66/117 |
| 9,181,641 | B1 * | 11/2015 | Moraca | D04B 3/02 | |

* cited by examiner

BENDABLE STRAIGHT KNITTING NEEDLE WITH TUBULAR MEMBER

CROSS-REFERENCE TO RELATED APPLICATIONS

This application is a continuation-in-part of application Ser. No. 14/599,284, filed on Jan. 16, 2015.

FIELD OF THE DISCLOSURE

The present invention relates to a bendable straight knitting needle, specifically a straight knitting needle made from any material. Accordingly, a method to realize this invention is also provided.

BACKGROUND

Standard straight knitting needles generally range from 10-16 inches, being a narrow stiff shaft that tapers at one end and has a knob at the other end to prevent stitches from slipping off. Straight knitting needles are known to be made of plastic, metal, casein, or wood. These needles are used in knitting to pull loops of string through one another. Needles come in the thickness from 0.75 mm to 25 mm and are commonly marked with U.S. or U.K. sizes that correspond to the mm thickness. The long narrow stiff shaft is not bendable and can therefore result in pain, tiredness and numbness from repeated motion of wrists, hands, and fingers during the formation of loops in the knitting position that must accommodate to the long straight stiff knitting shaft as well as difficulty maneuvering comfortably while knitting in confined spaces and around surrounding obstacles.

SUMMARY

In accordance with the invention, the advantage of the bendable connection between knitting needles is the ability to bend the needle during formation of loops in a more comfortable manner for arm, wrist, hand, and finger movements as well as more ease of knitting movement in a confined work space.

The present invention relates to a bendable straight knitting needle consisting of two relatively stiff shanks. Each shank has two ends. One embodiment has a tubular member member. The tubular member has two ends and can be made of any flexible material such as polyurethane. A first shank has one pointed at one end and a joint back end with one end of the tubular member in positioned within the joint end of said first shank. A second shank has one end with a knob and a joint end that attaches to the second end of said tubular member and the joint ends of the shanks form a joint that allows the knitting needle to bend during use.

In another embodiment, the first shank has one pointed at one end and one back end with the internal screw threads in position within the back end. The second shank has one end with a knob and back end with internal screw threads in position within the back end, wherein said shanks are connected with each other by the back ends with a bendable vinyl hollow connecting tube containing a metal coil with external metal screw attached at each end of the coil comprising a joint. The joint between the stiff shanks and the bendable hollow connecting tube consisting of an external metal screw attached to the metal coil at each end and protruding out of the tube that contains the metal coil to be inserted into the back end of the shank wherein internal screw threads are positioned.

DETAILED DESCRIPTION OF EMBODIMENTS

Figure 1:
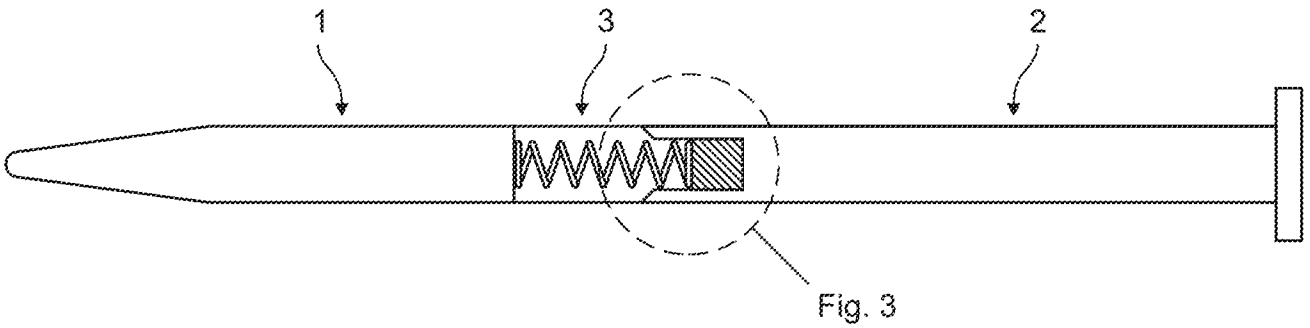
FIG. 1 illustrates a perspective schematic view of the present invention. The two relatively stiff ends of the needle are denoted by 1,2 whereas the bendable connecting tube between the two shanks is denoted by 3. The shank is made from plastic whereas the bendable connecting tube is made from vinyl. See FIG. 1.
Figure 2:
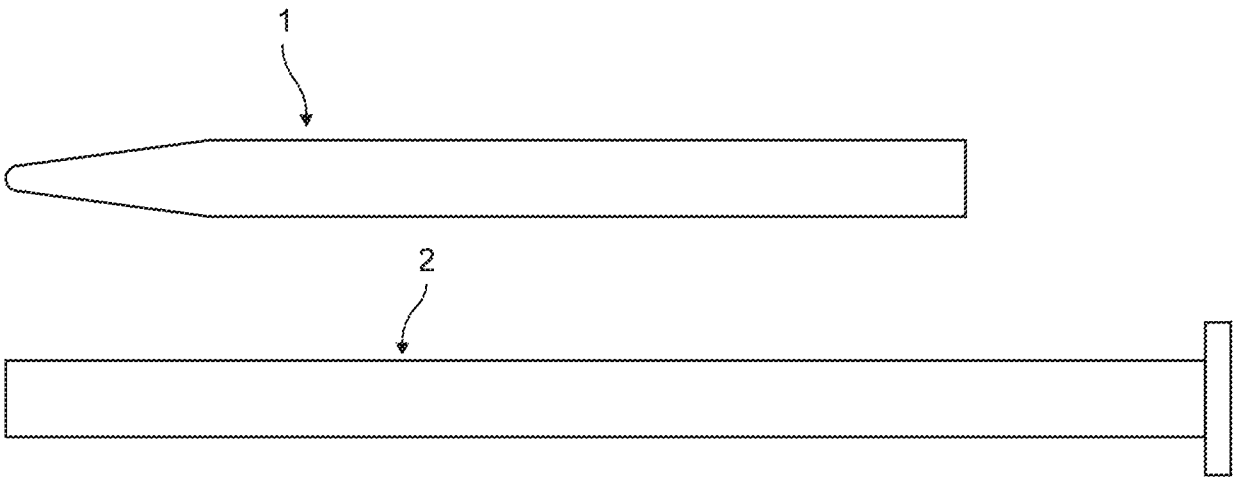
FIG. 2 illustrates one end of the needle or shank (1) which is pointed at one end and the other end forms a joint with the bendable connecting tube and one end of the knobbed shank (2) which has a knob at one end and the other end forms a joint with the bendable connecting tube. See FIG. 2.
Figure 3:
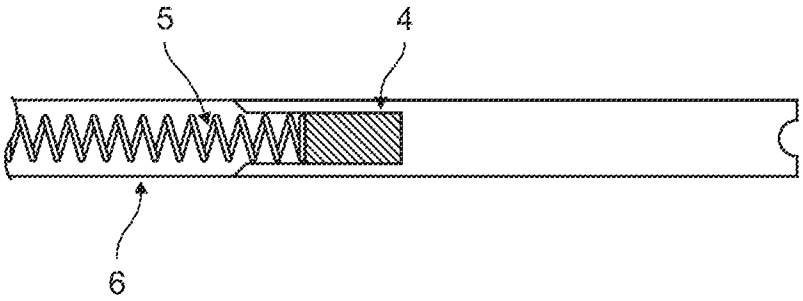
FIG. 3 illustrates the junction between the shank and the bendable connecting tube where the external screw (4) and metal coil (5) are connecting, and the coil contained in the vinyl tubing (6) are shown in detail. See FIG. 3.
Figure 4:
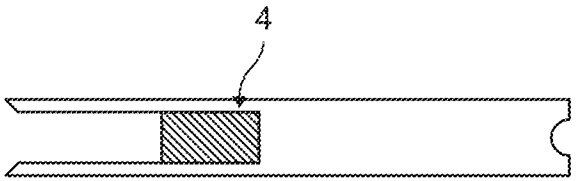
FIG. 4 illustrates positioning of the drilled internal screw threads (4) in the back end of each shank and the design of which shows an inward curvature that will insure a strong and even one-level closure when the connecting vinyl tube is attached. See FIG. 4.
Figure 5:
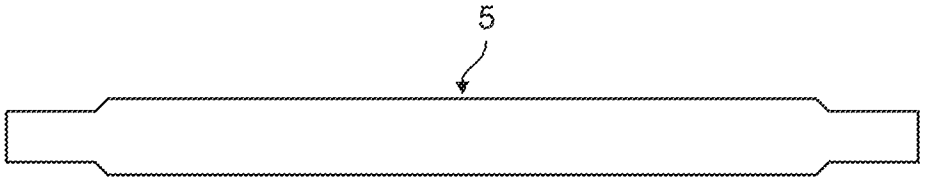
FIG. 5 illustrates the design of the bendable vinyl tubing that will connect the two stiff shafts at their back ends. A portion of the end of the vinyl tubing that contains the metal coil will also be inserted into the back end of shaft. The design shows two slanted edges at each end of bendable tube that will meet the opposing slanted edge of the shafts during attachment. This will insure a strong and even one-level closure when connecting. See FIG. 5.
Figure 6:
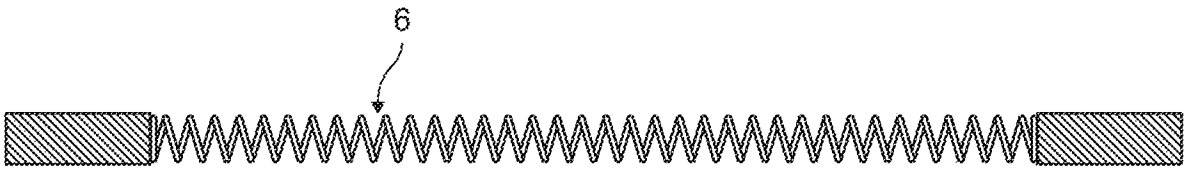
FIG. 6 illustrates the metal coil that will be contained in the vinyl tubing with the external screws (4) attached at each end which will protrude outward from the bendable vinyl tube. See FIG. 6. Various modifications and altercations of this invention will become apparent to those skilled in the art without departing from the scope and spirit of this invention and it should be understood that this invention is not unduly limited to the illustrative embodiment set forth herein.

The detailed description set forth below in connection with the appended drawings is intended to provide example embodiments of the present invention and is not intended to represent the only forms in which the invention may be constructed or utilized. The description sets forth the function and the sequences of steps for constructing and operating the invention. However, it is to be understood that the same or equivalent functions and sequences may be accomplished by different embodiments that are also intended to be encompassed within the spirit and the scope of the invention.

The bendable straight knitting needle with ergonomic benefit consists of two stiff shanks 1, 2 pointed at one end 1 and one knob end 2 and suitably machined for attachment at the other ends.

In one embodiment, the product consists of two stiff shanks, 1, 2, one suitably pointed at one end for knitting and one with a knob at the base for holding knitted stitches, connected from the other ends using a bendable hollow vinyl tube 6 containing a metal coil 5 with attached metal external screws 4 at each end of coil 5. The joint between the stiff shank and the bendable connecting tube consists of internal screw threads 4 positioned inside the backend of each shank and a metal external screw 4 connected to the metal coil that is contained in the hollow vinyl tubing 6. The bendable tubing will be the same thickness as the shank and extremely smooth, enabling the individual stitches to slide over connection and tubing without impairment, and bendable for ergonomic benefit.

Another aspect of the invention is the method to realize this invention. The two stiff shanks 1, 2 of the knitting needle are made from plastic, metal, casein, or wood. The joint between the stiff shanks and the bendable tube 3 is made by inserting the external screw 4 which is attached to the metal coil 5 that is contained in the bendable vinyl tube 6 into the stiff shank where internal screw threads 4 are positioned and screwed and glued together.

The present invention relates an invention where, the stiff shanks 1, 2 are made of plastic whereas the bendable connecting tube 3 is made of bendable hollow vinyl, metal coiling 5, and attached external metal screw 4 at each end of coil. In the back ends of shaft 1, 2, internal screw threads 4 are positioned and drilled.

In another embodiment of the invention, a method for the manufacture of the bendable knitting needle is provided. The shanks are manufactured by conventional manufacturing processes. The addition of the bendable material is the substance of the invention.

The bendable material used in this form of vinyl hollow tubing 6 that matches the thickness of the stiff shanks 1, 2, metal coil 5, with attached metal external screws 4. This bendable tube 3 is connected to the stiff shanks using a protruding external screw 4 at each end of bendable tube to be inserted and screwed into the threads of the internal screw threads 4 which are positioned in the back ends of the stiff shanks.

The joint itself is made by the vinyl tubing 6 and metal parts with attached external screw 4, threaded to the internal screw threads within the plastic shanks 1, 2. The tolerances are such that they meet the requirements of the product and the joint.

The screw 4 is manufactured and attached to the metal coil 5, which is contained in the clear bendable vinyl tube 6.

The stiff shanks 1, 2, are made from the back end (the end that is not pointed or knobbed) finished to a diameter suited for development of a drilled internal screw. The external metal screw 4 that is attached to the metal coil 5, which is contained in the bendable vinyl tube 6 matches the thickness of the shank and is then inserted into the back ends of the stiff shanks.

The threaded portion of the external screw 4 is attached directly into the internal screw threads which are positioned within the shank. Adhesive may be applied to the threaded portions to ensure that is a permanent tight lock.

The above method results in a bendable straight knitting needle, which has the ability to bend in a manner that would be of ergonomic benefit in mobility and can accommodate more readily to a confined workspace.

In another embodiment, the invention relates to a bendable straight knitting needle 10 with ergonomic benefit, specifically, a long, thin, pointed rod from any material with a bendable addition which enables more natural and less labored movement of the arms, hands, wrists, and fingers during stitch formation compared to other knitting needles found in the prior art. The knitting needles are also advantageous when the surrounding work space is limited as the needles can bend. The bendable straight knitting needle with ergonomic benefit consists of two stiff shanks (20, 30) pointed at one end (22) and one knob end (34) and suitably machined for attachment at the other ends (24, 32).

Figure 7:
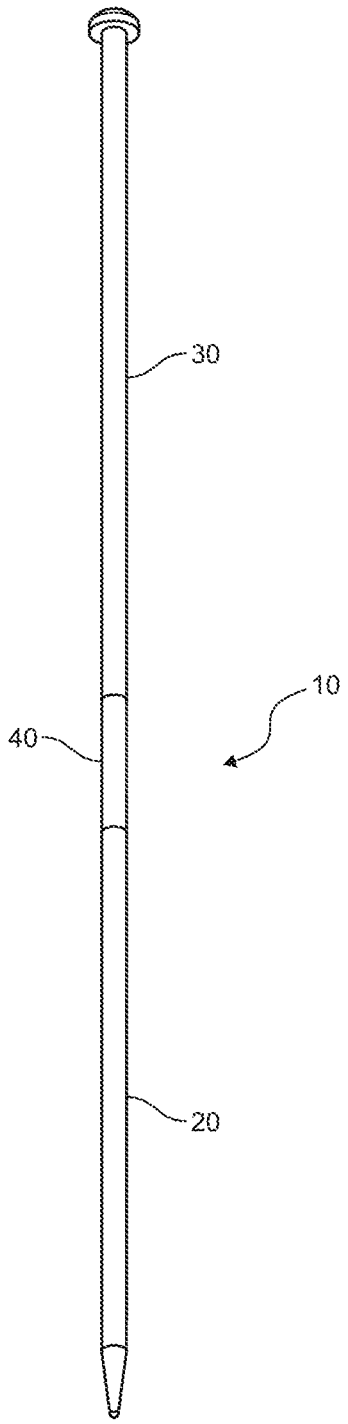
FIG. 7 illustrates a perspective view of the present invention. The two components or shanks of the needle 10 are denoted by 20, 30, whereas the bendable connecting tube or tubular member between the two shanks is denoted by 40.

FIG. 7 shows one embodiment with two shanks 20, 30 of the needle 10. A tubular member 40 is inserted in between the two shanks 20, 30. The two shanks 20, 30, of the knitting needle 10 may be made of plastic, metal, casein, or wood.

Figure 8:
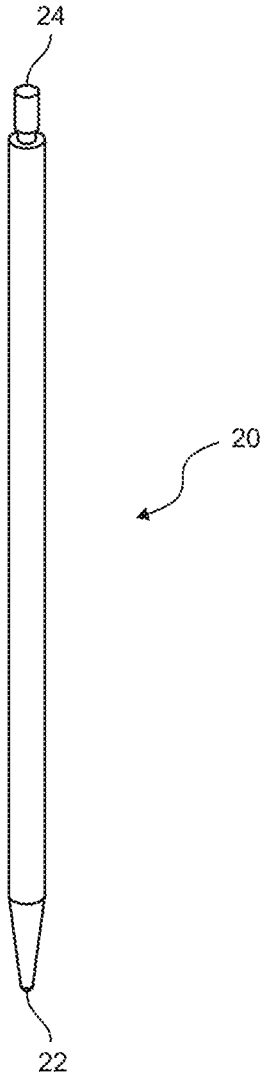
FIG. 8 illustrates a perspective view of one shank 20, which is pointed at one end 22 and the other end 24 forms a joint with the tubular member 40 and with a second shank 30.

FIG. 8 illustrates one shank 20 which has a pointed end 22 and has a joint end 24. Pointed end 22 is used to facilitate weaving together string or yarn while knitting. Joint end 24 forms a joint with the tubular member 40 and the joint end 32 of the second shank 30.

Figure 9:
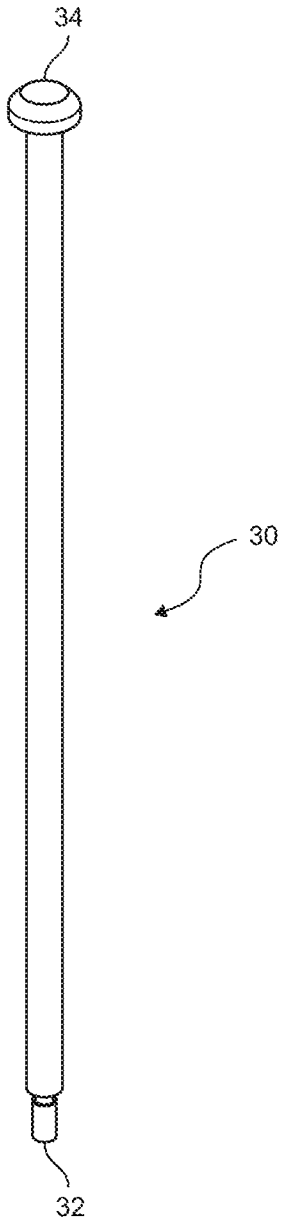
FIG. 9 illustrates a perspective view of a second shank 30, which has a knob at one end 34 and a joint end 32 forming a joint with the tubular member and with the first shank 20.

FIG. 9 illustrates a second shank 30 which has a knob end 34. The knob end 34 is used to prevent the string from slipping off the needle 10 when knitting. Second shank 30 has a a joint end 32 that forms a joint with the tubular member 40 and the joint end 24 of shank 20.

Figure 10:
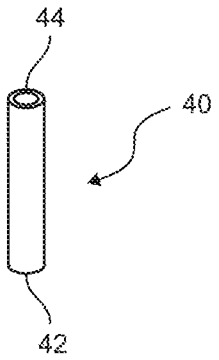
FIG. 10 illustrates a perspective view of the tubular member 40, which connects shanks 20, 30.

FIG. 10 illustrates the tubular member 40 used to form the joint between shank 20 and shank 30. Tubular member 40 may take the embodiment of a flexible tube or other shapes. Tubular member 40 has two ends 42 and 44 which connect to the joint ends 24, 32 of the shanks 20, 30, respectively.

The bendable material used to form the tubular member 40, may be shaped as a tube that matches the thickness of the shanks 20, 30. The tubular member 40 may be comprised of any flexible material known in the art including, but not limited to a spring, coil, magnet, rubber inserts, or cables. Materials in the preferred embodiment include thermoplastic elastomers, TPU (thermoplastic urethanes), and thermoset polyurethanes. The degree of flexibility of the joint between the shank 20, 30 will vary depending on the flexibility of the material used to make the tubular member 40.

Figure 11:
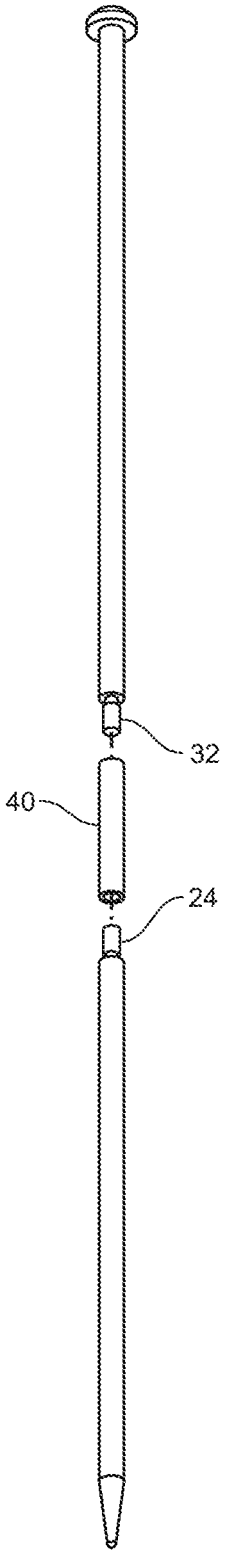
FIG. 11 illustrates a perspective view of shanks 20, 30 connected to tubular member 40.

FIG. 11 shows how shanks 20, 30 and the tubular member 40 are used to assemble the bendable knitting needle 10. The tubular member 40 is positioned between shanks 20, 30 and the joint ends of those shanks 24, 32 are inserted into ends 42 and 44 of the tubular member, respectively.

Figure 12:
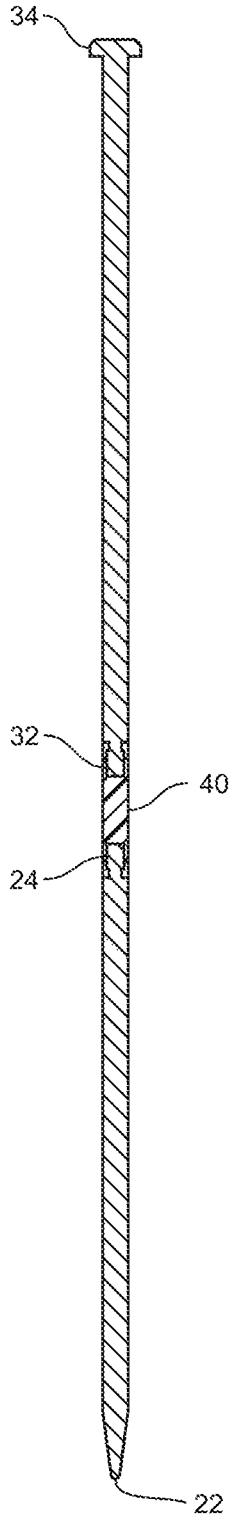
FIG. 12 illustrates a cross-section view of the invention of FIG. 7.

FIG. 12 illustrates a cross section of FIG. 7. As shown in FIG. 12, there is a spaced relationship or gap between the joint ends 24, 32 of the shanks 20, 30 when the joint ends 24, 32 are inserted into the tubular member 40. Depending on the various size (mm) of shanks 20, 30 will the density of the tubular member 40 be determined for bendability.

I claim:

1. A bendable straight knitting needle with ergonomic benefit comprised of:

at least two stiff shanks; wherein the first shank has a pointed end and a joint end and wherein the second shank has a knob end and a joint end;

a tubular member having a thickness equal to a thickness of said shanks and wherein the tubular member has at least two ends, each end has an opening that allows the insertion of said joint ends of said stiff shanks;

wherein the tubular member has a bendable connecting portion, said bendable connecting portion having two ends, said each end attached to the joint ends of said stiff shanks;

whereas, the two shanks are connected to each other by their joint ends via the tubular member such that the bendable connecting portion is capable of bending the knitting needle.

2. The bendable straight knitting needle of claim 1 wherein the shanks are made of a material consisting of plastic, metal, casein, or wood.

3. The bendable straight knitting needle in claim 1 wherein the resilient member is made of vinyl.

4. The bendable straight knitting needle in claim 1 wherein the resilient member is made of thermoplastic elastomers, TPU (thermoplastic urethanes), and also thermoset polyurethanes.

5. The bendable straight knitting needle of claim 1 wherein there is a space relationship between the joint ends of the shanks so that there can be relative movement between the shanks so as to allow natural mobility of hands during formation of knit loops.

6. A method of making a bendable straight knitting needle comprising of steps of:

forming at least two stiff shanks; wherein the first shank has a pointed end and a joint end and a second shank with a knobbed end and a joint end;

providing a tubular member having a thickness equal to a thickness of said shanks wherein the tubular member has at least two ends, each has an opening that allows the insertion of said joint ends of said shanks;

wherein the tubular member has a bendable connecting portion, said bendable connecting portion having two ends;

attaching the joint ends of at least two stiff shanks to the two ends of the bendable connecting portion such that the at least two stiff shanks is capable of inserting to the tubular member;

whereas the bendable connecting portion provides flexibility during creation of knit loops, thus relieving pressure to portions of knitter's fingers, wrists, and hands.

7. A method of knitting comprising:

providing at least two stiff shanks; wherein the first shank has a pointed end and a joint end and a second shank with a knobbed end and a joint end;

providing a tubular member having a thickness equal to a thickness of said shanks wherein the tubular member has a bendable connecting portion with at least two ends, said each end has an opening that allows the insertion of said joint ends of said shanks;

forming knit loops by manipulating the at least two connected stiff shanks while bending the bendable connecting portion and causing relative movement between the at least two stiff shanks and between the tubular member, thus minimizing and alleviating physical stress on the user.

* * * * *